US007753033B2

(12) United States Patent
Perez et al.

(10) Patent No.: US 7,753,033 B2
(45) Date of Patent: Jul. 13, 2010

(54) FUEL MODULE WITH ORIFICE UPSTREAM FROM REGULATOR

(75) Inventors: Billy O. Perez, Chihuahua (MX); Luis M. Porras, Chihuahua (MX)

(73) Assignee: Delphi Technologies, Inc., Troy, MI (US)

( * ) Notice: Subject to any disclaimer, the term of this patent is extended or adjusted under 35 U.S.C. 154(b) by 124 days.

(21) Appl. No.: 12/231,885

(22) Filed: Sep. 5, 2008

(65) Prior Publication Data

US 2010/0059025 A1 Mar. 11, 2010

(51) Int. Cl.
*F02M 37/04* (2006.01)

(52) U.S. Cl. ..... 123/509; 123/457

(58) Field of Classification Search ..... 123/457, 123/458, 509, 510, 511, 514
See application file for complete search history.

(56) References Cited

U.S. PATENT DOCUMENTS 4,926,829 A * 5/1990 Tuckey ..... 123/497
5,148,792 A * 9/1992 Tuckey ..... 123/497
5,220,941 A * 6/1993 Tuckey ..... 137/510
5,289,810 A * 3/1994 Bauer et al. ..... 123/510
5,361,742 A * 11/1994 Briggs et al. ..... 123/506
5,398,655 A * 3/1995 Tuckey ..... 123/456
5,533,478 A * 7/1996 Robinson ..... 123/510
5,692,479 A * 12/1997 Ford et al. ..... 123/514
5,715,798 A * 2/1998 Bacon et al. ..... 123/514
5,727,529 A * 3/1998 Tuckey ..... 123/514
5,749,345 A * 5/1998 Treml ..... 123/456
5,752,486 A * 5/1998 Nakashima et al. ..... 123/467
5,762,048 A * 6/1998 Yonekawa ..... 123/514
5,791,317 A * 8/1998 Eck ..... 123/510
5,873,349 A * 2/1999 Tuckey et al. ..... 123/514
6,024,064 A * 2/2000 Kato et al. ..... 123/179.17
6,068,022 A * 5/2000 Schultz et al. ..... 137/538
6,253,740 B1 * 7/2001 Rembold ..... 123/509
6,260,543 B1 * 7/2001 Chih ..... 123/509
6,343,589 B1 * 2/2002 Talaski et al. ..... 123/514
6,520,163 B2 * 2/2003 Yoshioka et al. ..... 123/510
6,805,106 B2 * 10/2004 Kumagai et al. ..... 123/514
6,953,026 B2 * 10/2005 Yu et al. ..... 123/510
6,966,305 B2 * 11/2005 Aubree et al. ..... 123/509
7,316,222 B2 * 1/2008 Danjyo ..... 123/509
7,370,640 B2 * 5/2008 Dickenscheid ..... 123/510
7,383,821 B2 * 6/2008 Gras et al. ..... 123/509
7,431,020 B2 * 10/2008 Ramamurthy ..... 123/497
7,458,362 B2 * 12/2008 Hazama et al. ..... 123/457
2002/0043253 A1 * 4/2002 Begley et al. ..... 123/497
2003/0015238 A1 * 1/2003 Martin ..... 137/384
2005/0161027 A1 * 7/2005 Maroney ..... 123/510

* cited by examiner

*Primary Examiner*—Thomas N Moulis
(74) *Attorney, Agent, or Firm*—Thomas N. Twomey

(57) ABSTRACT

A fuel module for a vehicle has a module housing in fluid communication with a fuel tank of the vehicle and supporting a fuel pump. A pressure regulator is in the module housing and the regulator receives fuel from the pump. An orifice is disposed in a fluid path between the pump and the intake of the regulator.

17 Claims, 3 Drawing Sheets

FUEL MODULE WITH ORIFICE UPSTREAM FROM REGULATOR

FIELD OF THE INVENTION

The present invention relates generally to fuel modules, and more particularly to fuel modules for motor vehicles.

BACKGROUND OF THE INVENTION

Fuel modules have been provided in which much of a vehicle's fuel system is enclosed in a single housing. Thus, a fuel module may include a fuel pump, a fuel strainer, a pressure regulator, and a fuel filter, and typically is mounted on or in the fuel tank of the vehicle.

As recognized herein, in an effort to provide higher and/or variable fuel pressure as demanded by some engines, modules have incorporated combinations of structures that undesirably create noise, oscillation, or that consume excessive space.

SUMMARY OF THE INVENTION

A fluid module for a vehicle has a module housing, a fluid pump supported by the module housing, and a fluid pressure regulator in communication with the pump and mounted in the module housing. A flow restrictor is disposed in a fluid conduit that establishes a fluid intake of the regulator.

In example embodiments the fluid is fuel and the flow restrictor is an orifice. A fuel filter may be disposed in the housing for receiving fuel from the pump. The orifice can be established by a disk-shaped orifice plate that is solid except for an orifice hole in the plate defining a diameter smaller than an inside diameter of the conduit.

In non-limiting embodiments a filter housing is in the module housing for holding the filter. The filter housing establishes a discharge conduit in communication with the fluid conduit in which the orifice is disposed.

In another aspect, a fuel module for a vehicle has a module housing disposable in fluid communication with a fuel tank of the vehicle and supporting a fuel pump. The module further includes a pressure regulator in the module housing and receiving fuel from the pump. An orifice is disposed in a fluid path between the pump and regulator.

In another aspect, an a fuel module having a module housing configured for fluid communication with a fuel tank to support a fuel pump and a fuel regulator, fluid path means are provided between the pump and an intake to the regulator for establishing fluid communication therebetween. Means are provided in the fluid path means for restricting fluid flow through the fluid path means.

The details of the present invention, both as to its structure and operation, can best be understood in reference to the accompanying drawings, in which like reference numerals refer to like parts, and in which:

DETAILED DESCRIPTION OF THE PREFERRED EMBODIMENT

The present invention is intended for application in automotive vehicle systems and will be described in that context. It is to be understood, however, that the present invention could also be successfully applied in other fuel delivery applications.

Figure 1:
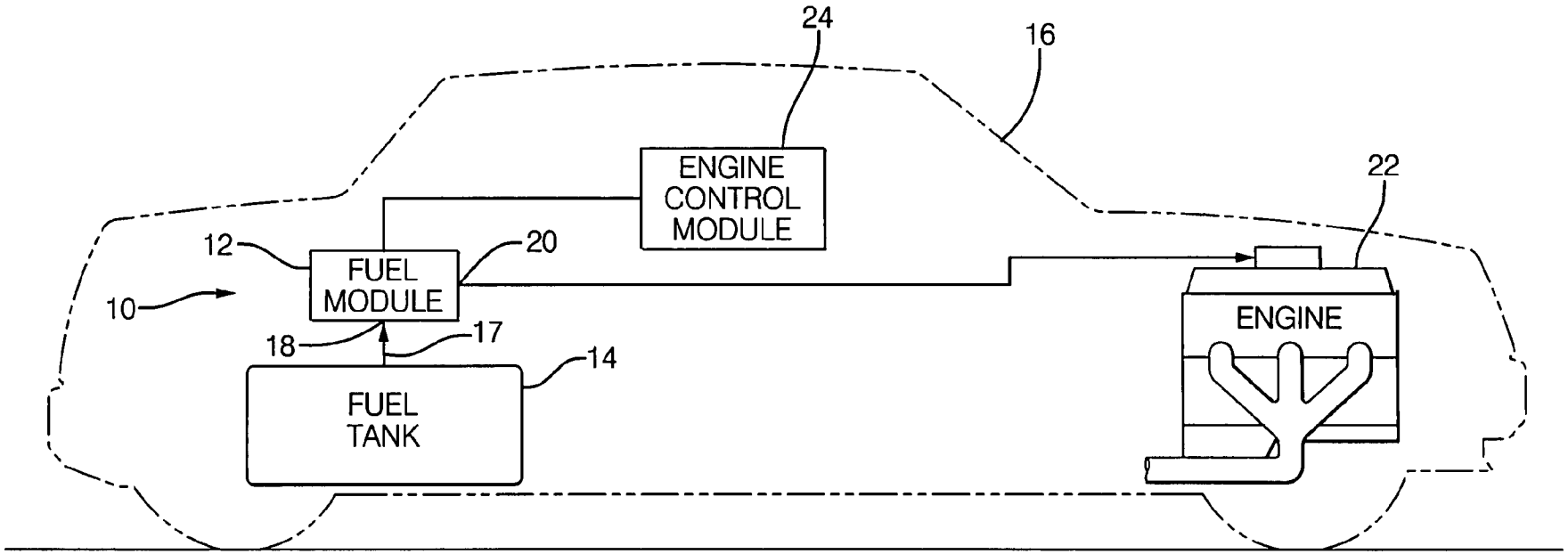
FIG. 1 is a schematic view of the fuel module in one example environment.

Referring initially to FIG. 1, a fuel module is shown, generally designated 10, that includes a hollow lightweight metal or plastic enclosed housing 12 communicating with a fuel tank 14 of a vehicle 16. While FIG. 1 shows that the module 10 is distanced from the fuel tank 14 and connected thereto by one or more fuel lines 17, it is to be understood that the module 10 may be disposed in or on the tank 14, e.g., the module 10 may rest on the bottom of the tank 14.

In any case, the module 10 receives fuel at a supply port 18 from the fuel tank 14 and discharges fuel at a discharge port 20 to an engine 22, typically under control of a computer such as an engine control module (ECM) 24.

Figure 2:
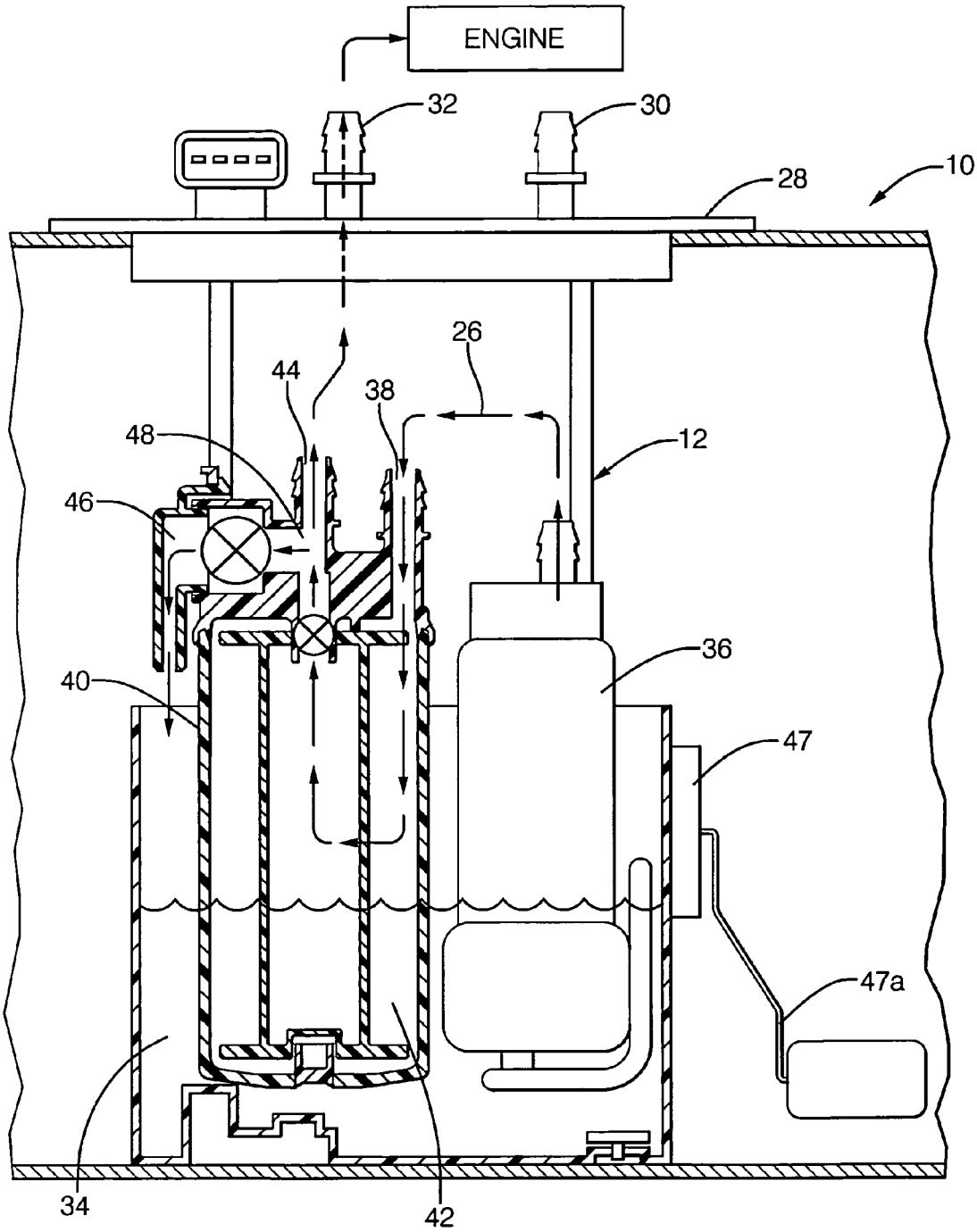
FIG. 2 is a side view of an example module showing various internal components.

FIG. 2 shows internal components of an example module 10 in which arrows 26 illustrate the direction of fuel flow through the module housing 12. As shown, a cover 28 covers the top of the module housing 12. The supply port 18 shown in FIG. 1 may be established by a supply conduit 30 that extends through the cover 28, it being understood that the supply conduit 30 thus communicates with the fuel tank 14 shown in FIG. 1 via, e.g., a fuel line. Similarly, the discharge port 20 shown in FIG. 1 may be established by a discharge conduit 32 that extends through the cover 28, it being understood that the discharge conduit 32 thus communicates with the engine 22 shown in FIG. 1 via, e.g., a fuel line. Both the housing 12 and cover 28 may be respective unitary pieces of material such as plastic or metal.

It may be appreciated in reference to FIG. 2 that a fuel reservoir 34 is formed within or by the housing 12, with a fuel pump 36 being disposed in the housing 12 and taking suction on the reservoir 34. As shown by the arrows 26, the fuel pump 36 discharges fuel to an intake conduit 38 of a fuel filter housing 40 within the module housing 12. The fuel filter housing 40 holds a fuel filter 42.

The fuel filter 42 is configured to remove impurities from fuel passing through it. The fuel filter housing 40 includes a discharge conduit 44 which communicates with the discharge conduit 32 of the module housing 12 to send filtered fuel to the engine.

Also communicating with the discharge conduit 44 of the fuel filter housing 40 is a pressure regulator 46. In the embodiment shown, the regulator 46 employs a ball-and-spring mechanism to establish pressure in the discharge conduit 44 typically under control of, e.g., the ECM 24 shown in FIG. 1, although other types of pressure regulators may be used. In any case, a level sensor 47 that may include a float arm 47*a* may be provided to sense fuel level in the reservoir 34 or the fuel tank 14.

Figure 3:
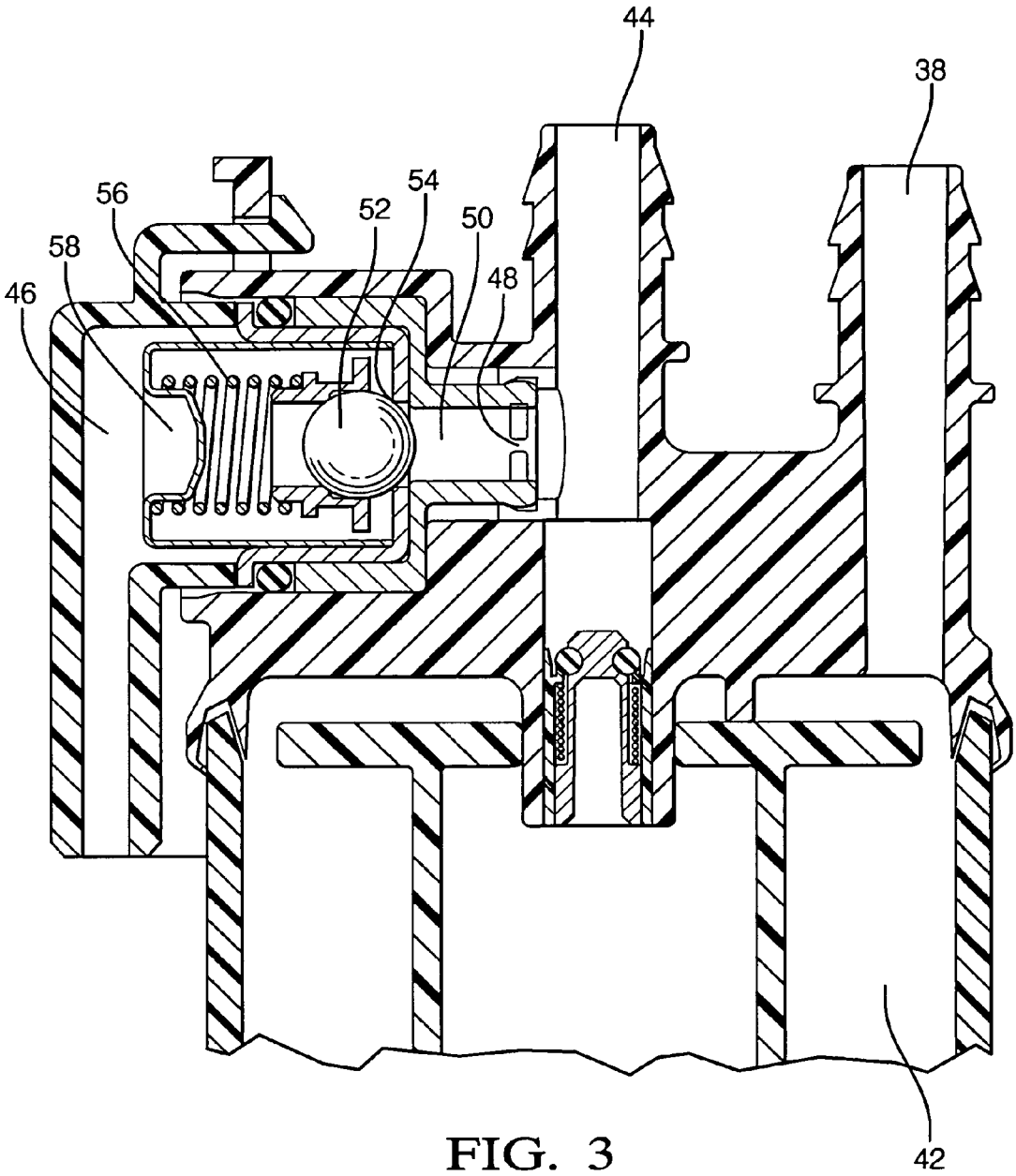
FIG. 3 is another side view of the example module showing details of internal components.

As shown in FIG. 2 and now moving to FIG. 3 for a more detailed view, an orifice 48 is disposed between the regulator 46 and the discharge conduit 44 at the intake of the regulator, through which fuel passes back into the reservoir 34. As shown best in FIG. 3, a connector conduit 50 may be used to establish fluid communication between the regulator 46 and discharge conduit 44, and the orifice 48, which defines a diameter that is smaller than the diameter of the connector conduit 50 as shown, may be disposed in or made integrally with the connector conduit 50 such that fuel flows through the orifice 48 prior to entering the pressure regulating mechanism of the regulator 46. Other flow restriction devices such as a Venturi tube may be used in lieu of the orifice 48 if desired.

In any case and as may be readily appreciated in reference to FIG. 3, the orifice 48 typically may be established by a disk-shaped plate that is otherwise solid except for an orifice hole formed in the plate, typically although not necessarily in the center of the plate.

As shown, the non-limiting regulator 46 includes a ball 52 that is moved toward and away form a seat 54 by a spring 56 and reciprocating diaphragm 58 typically under control of the ECM 24 to regulate the pressure of fuel discharged to the engine 14, although as mentioned above other pressure regulation mechanisms may be used.

While the particular FUEL MODULE WITH ORIFICE UPSTREAM FROM REGULATOR is herein shown and described in detail, it is to be understood that the subject matter which is encompassed by the present invention is limited only by the claims. For example, in addition to the above connection mechanisms, other quick connect/quick disconnect type of mechanisms may be used.

What is claimed is:

1. A fluid module for a vehicle, comprising:

a module housing;

a fluid pump supported by the module housing;

a fluid pressure regulator in communication with the pump and mounted in the module housing; and a flow restrictor disposed in a fluid conduit establishing a fluid intake of the regulator.

2. The module of claim 1, wherein the fluid is fuel and the flow restrictor is an orifice.

3. The module of claim 2, comprising a fuel filter in the housing and receiving fuel from the pump.

4. The module of claim 3, wherein the orifice is established by a disk-shaped orifice plate that is solid except for an orifice hole in the plate defining a diameter smaller than an inside diameter of the conduit.

5. The module of claim 4, comprising a filter housing in the module housing and holding the filter, the filter housing establishing a discharge conduit in communication with the fluid conduit in which the orifice is disposed.

6. The module of claim 1, comprising a vehicle fuel tank in fluid communication with the module housing.

7. A fuel module for a vehicle, comprising:

a module housing disposable in fluid communication with a fuel tank of the vehicle and supporting a fuel pump;

a pressure regulator in the module housing and receiving fuel from the pump; and an orifice disposed in a fluid path between the pump and regulator.

8. The module of claim 7, comprising a fuel filter in the housing and receiving fuel from the pump.

9. The module of claim 7, wherein the orifice is established by a disk-shaped orifice plate that is solid except for an orifice hole in the plate defining a diameter smaller than an inside diameter of the fluid path.

10. The module of claim 7, comprising a filter housing in the module housing and holding a fuel filter, the filter housing establishing a discharge conduit in communication with the fluid path in which the orifice is disposed.

11. The module of claim 7, comprising a vehicle fuel tank in fluid communication with the module housing.

12. In a fuel module having a module housing configured for fluid communication with a fuel tank to support a fuel pump and a fuel regulator:

fluid path means between the pump and an intake to the regulator for establishing fluid communication therebetween; and means in the fluid path means for restricting fluid flow through the fluid path means.

13. The module of claim 12, wherein the means for restricting fluid flow includes an orifice.

14. The module of claim 12, comprising a fuel filter in the module housing and receiving fuel from the pump.

15. The module of claim 13, wherein the orifice is established by a disk-shaped orifice plate that is solid except for an orifice hole in the plate defining a diameter smaller than an inside diameter of the fluid path means.

16. The module of claim 12, comprising a filter housing in the module housing and holding a fuel filter, the filter housing establishing a discharge conduit in communication with the fluid path means.

17. The module of claim 12, comprising a vehicle fuel tank in fluid communication with the module housing.

* * * * *